United States Patent [19]

Thomas et al.

[11] Patent Number: 4,835,939

[45] Date of Patent: Jun. 6, 1989

[54] PACKAGING SYSTEM

[75] Inventors: Richard D. Thomas, Winston-Salem; Cecil R. Bell, Jr., Pinnacle, both of N.C.

[73] Assignee: Sara Lee Corporation, Winston-Salem, N.C.

[21] Appl. No.: 141,580

[22] Filed: Jan. 7, 1988

[51] Int. Cl.[4] ..... B65B 5/04

[52] U.S. Cl. ..... 53/248; 53/253; 53/282; 53/307

[58] Field of Search ..... 53/248, 251, 253, 276, 53/282, 307; 141/148, 150

[56] References Cited

U.S. PATENT DOCUMENTS

| | | | |
|---|---|---|---|
| 2,137,389 | 11/1938 | Chapman | 141/150 X |
| 2,684,803 | 7/1954 | Birkland | 141/150 X |
| 2,729,377 | 1/1956 | O'Neil | 141/150 X |
| 2,761,605 | 9/1956 | Pahl | 141/148 X |
| 3,492,785 | 2/1970 | Mancini | 53/282 |
| 3,552,454 | 1/1971 | Deming, Sr. | 141/71 |
| 3,707,825 | 1/1973 | Bell et al. | 53/282 |
| 4,104,846 | 8/1978 | Waller | 53/248 X |
| 4,168,599 | 9/1979 | King | 53/471 |
| 4,189,259 | 2/1980 | King | 406/63 |
| 2,8997,643 | 8/1959 | Byrd | 53/59 |

FOREIGN PATENT DOCUMENTS

| | | | |
|---|---|---|---|
| 766597 | 9/1967 | Canada | 53/282 |

*Primary Examiner*—John Sipos

*Attorney, Agent, or Firm*—Charles Y. Lackey; William S. Burden

[57] ABSTRACT

A system for packaging articles within containers, each container being generally egg shaped and having an open end for receiving the articles and having a generally planar closure applied to the open end thereof to confine the articles therein. The system includes a multi-station intermittently rotatable generally circular turret or carousel carrier disk having a plurality of radial slots, each fixedly mounting a canister for receiving and temporarily confining articles therein fed into the top thereof during partial rotation or indexing of said turret or carousel and for receiving an open container fed into the bottom during the remainder of the rotation thereof. These canisters are open at both ends for systematically receiving the articles and containers in timed relation. Highly polished reciprocatable fingers are selectively positioned beneath the canisters when such are located at prescribed locations to confine the articles therein. At a selected position a container is fed beneath the canister, the fingers retracted and the article falls into a container as the container is fed upwardly into the bottom of the cannister. A flat disk-shaped lid is located on the top of the canister above the now loaded container and a vertically reciprocable pusher finally inserts the lid into the opened end of the loaded container. The loaded container is deflected to a conveyor which directs the same to a boxing or cartoning mechanism.

21 Claims, 3 Drawing Sheets

PACKAGING SYSTEM

BACKGROUND BRIEF SUMMARY OF THE INVENTION

The present invention relates to devices for continuously packaging articles, such as delicate hosiery, pantyhose and the like, within containers which include an initially opened article receiving cavity or recessed portion and a lid portion applied to the opening after one or more articles have been placed therein to close the container and confine the articles therein. This broad idea is common in the art as shown, for example, by the U.S. Patents to Bell et al, No. 3,707,825 and King, No. 4,168,599 both of which are assigned to the same assignee as the present invention. These prior art systems are employed to package articles within containers in the general shape of an egg, divided into upper and lower halves with the lower half being the article receiving portion and the upper half being the lid or cover. These prior art devices are bulky, complicated and expensive to manufacture. Other systems are shown by Byrd, U.S. Pat. No. 2,897,643; Deming Sr., U.S. Pat. No. 3,522,454; and King, U.S. Pat. No. 4,189,259.

The present invention is relatively simple and inexpensive to manufacture as compared with the prior art. Only one portion or half of a generally egg shaped container is employed and a flat disk is inserted in the opened top thereof to form a cover or lid for the container. The upper opened end of the container is provided with a rim or band-like portion to receive said disk.

Briefly, the apparatus includes a multi-station, intermittently rotatable, generally circular turret assembly having mounted along the periphery thereof a plurality of canisters for temporarily confining articles therein. As the turret or carousel indexes or intermittently rotates through these stations, an open-ended container is inserted into the canister to receive the article temporarily stored therein. At subsequent stations a disk-shaped lid or cover is applied to the open-ended container to form a sealed container andthe container removed from the carousel and transferred to a packaging station.

One of the primary objects of the invention is the provision of a new and improved packaging system.

Another object of the invention resides in the fact that a more simplified container is employed thereby eliminating complicated handling mechanism while only adding simple, efficient mechanism for handling a flat disk. With this arrangement a container can be used that has a substantially planar base for resting on a like surface unlike an egg shaped container.

Other objections and advantages of the invention will become apparent when considered in view of the following detailed description:

DESCRIPTION OF THE FIGS. OF THE DRAWINGS

GENERAL DESCRIPTION AND OPERATION OF THE INVENTION

The present disclosure is directed to the automatic packaging of articles in containers which includes positioning one or more articles within upwardly opened containers as they are indexed or intermittently displaced in an arcuated path and enclosing the articles by applying a cover or lid portion to the container.

Figure 1:
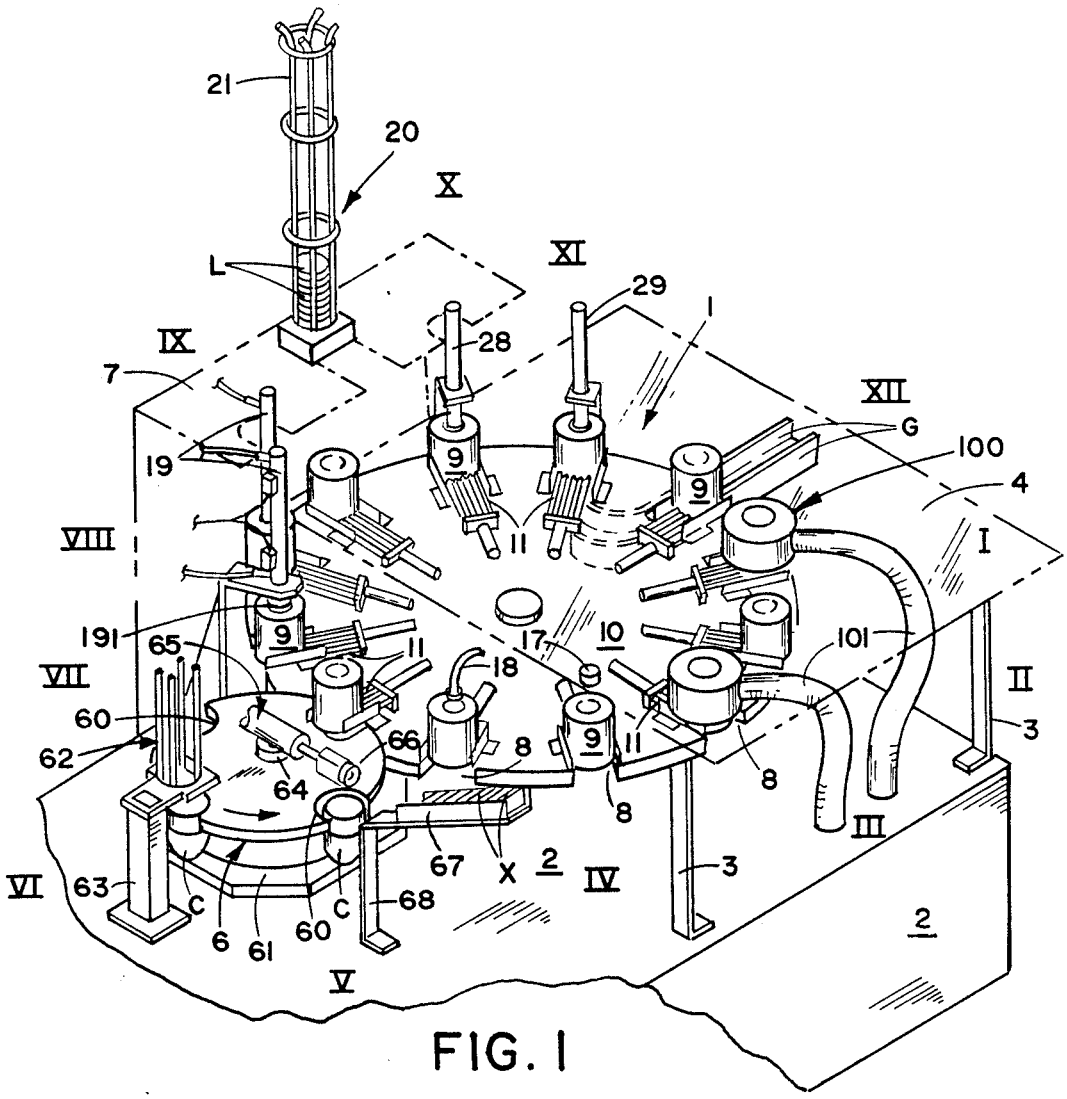
FIG. 1 is a fragmentary perspective view of a system for packaging delicate articles such as hosiery or the like in an open-ended container and then placing a closure member thereon to confine the article therein.
Figure 2:
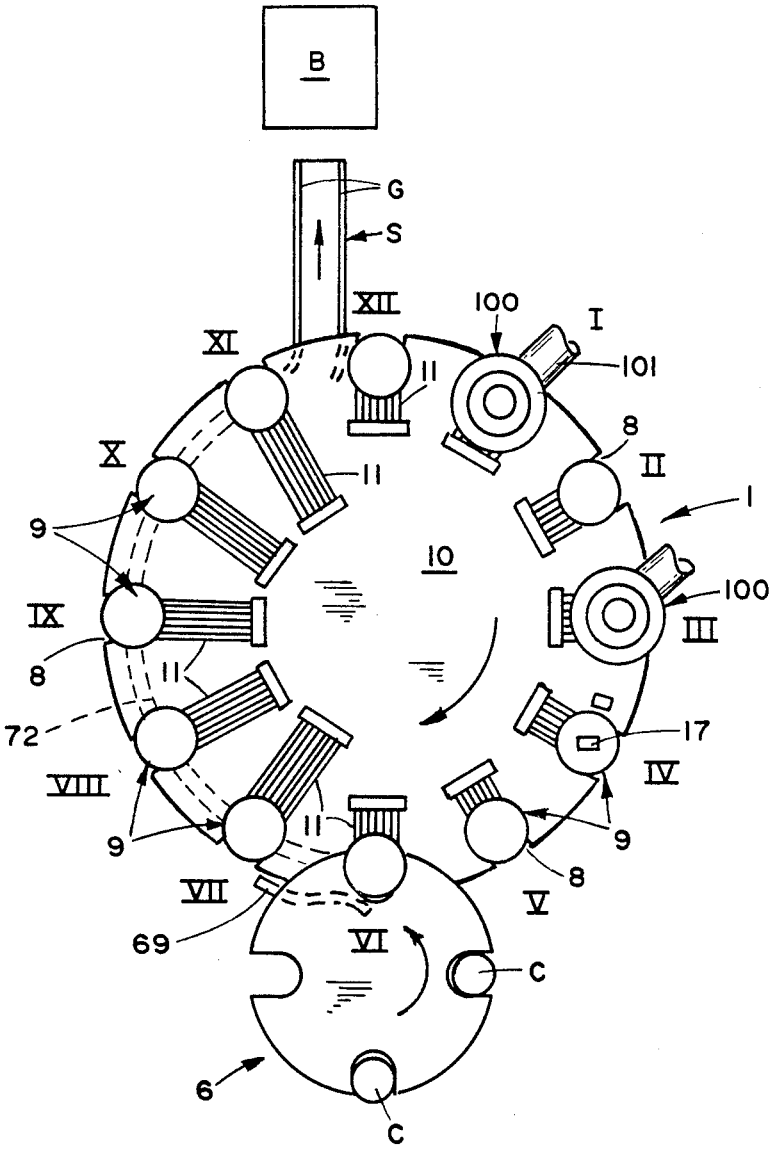
FIG. 2 is a top plan view of FIG. 1 showing the various stations which perform the various functions associated therewith.
Figure 6:
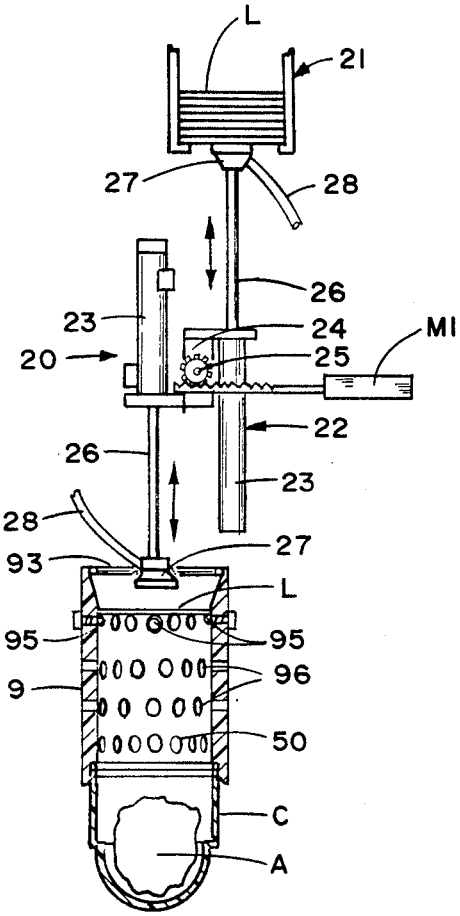
FIG. 6 is a view of the container lid applying device.

Referring particularly to FIGS. 1 and 2, carousel or turret 1 as illustrated includes twelve (12) sections. A gate means in the form of displaceable fingers 11, and a canister 9 are provided at each of the twelve spaced sections. Twelve stations or zones I–XII are provided around the turrent 1, as shown by FIGS. 1 and 2. A motor M2 selectively activated through a control system CS indexes the canisters through the twelve stations or zones. At station XI a cover or lid L has been finally inserted into the upper open end of a container or receptable C, thus, completing the packaging function of that individual package and as the turret or carousel continues its travel, a slide or chute S having upstanding guides G intercepts the lower exposed portion of the package container C and directs the same to a transfer mechanism and packaging mechanism as shown schematically at station B. At this time an actuator 13, FIG. 3, has been commanded to extend polished fingers 11 through openings in a canister 9 at station XII and then the turret or carousel indexes the canister to station I directly beneath an articles delivery vacuum or suction device 100 which inserts, as by suction or vacuum, one or more articles A in said canister with the article or articles resting on the polished fingers. This disclosure illustrates a two attendant arrangement, one attendant station being located at station I and the other at station III. An intervening station II provides room for two attendant stations and a visual area to determine the presence or absence of an article in the canister thereat to alert the second attendant. Station IV is provided with a common and well known sensing device 17 which detects the presence of an article in the canister 9 and commands a container supply turret or carousel 6 to deliver container C to station VI for subsequent reception of the article. At station V an air blast device 18 is provided to insure that the article is resting on the polished fingers or rods 11 in position to be released and fall in the container at station VI where the fingers or rods are retracted. At stations VII and VIII are provided vertically positioned fluid actuated motors 19 having pusher rods for insertion into the canisters 9 to insure that the articles have been loaded into the containers C. Both of the motors 19 are employed only when large bulky articles are being packaged which may not free fall into the container C when the fingers are retracted. A container lid supply and applying mechanism 20 begins at station IX and ends at station XI. For purposes of clarity only the lid supply magazine 21 is shown at station IX in FIG. 1. The device 22 for removing a lid L from supply magazine 21 and placing same slightly into or on the top of the upper end of the canister 9 is illustrated in FIG. 6. After leaving station IX and arriving at station X a pusher device 28 pushes the lid into a recess R in the upper open end of the container to seal and close the container with the article therein. At station XI a pusher 29 removes the container from the canister. Further indexing causes the now filled container to be transferred to a boxing or cartoning system.

Figure 3:
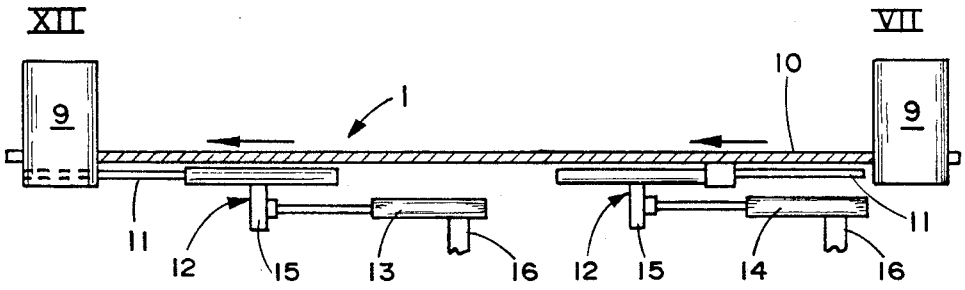
FIG. 3 is a fragmentary side elevational view of the devices employed to move the fingers to and from the loading canisters.
Figure 9:
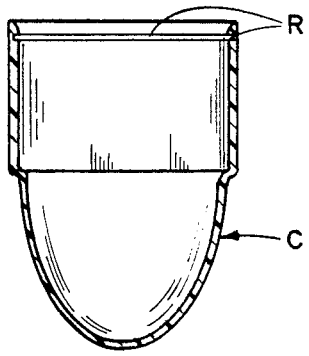
FIG. 9 is an enlarged sectional view of a container.
Figure 5:
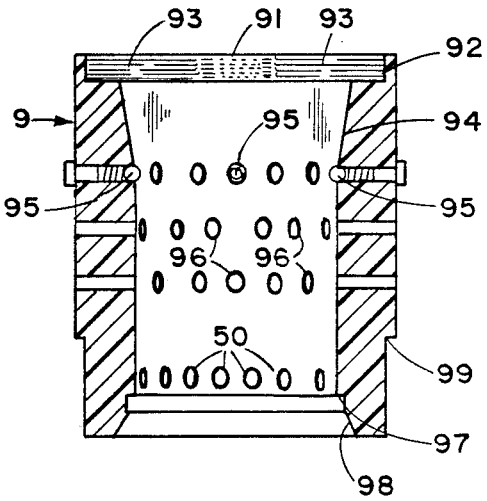
FIG. 5 is an enlarged cross-sectional view of a canister.

As viewed in FIG. 1 and 3 the above broadly described matter, as well as the carousel or turret 1 are supported by a housing structure 2 having various upstanding members 3 supporting various structure of the invention such as planar platform 4 which has an arcuate cut-out section to accommodate the circular carousel or turret 1. A further support 61 which supports a small four station container supplying carousel or turret 6 is illustrated as being mounted on the top of housing 2 but could be constructed independently thereof. A still further structure 7 supports the lid or cover supply magazine 20 and structure associated therewith which will be discussed later. Carousel or turret 1 is provided with plural substantially equally spaced slots 8 within which a like number of cylindrical open-ended canisters 9, FIG. 5, are fixedly mounted. These canisters 9 are provided with series of slightly elevated openings 50 adjacent the lower portions thereof for receiving reciprocating highly polished fingers 11 carried by supports 12. The fingers 11 in extended position, left in the view of FIG. 3, extend through the openings 50. Also, shown in FIG. 3 the finger actuating means are illustrated at 13 and 14. These actuators are common and well known fluid actuated piston-cylinder arrangements and are by means 16 fixedly attached to support structure 2. Each arrangement merely engages a depending member 15 on support 12 causing same to move the fingers 11 between positions remote to and beneath the canister shown at the right and left portions of FIG. 3. Once the actuators have performed their function they are immediately retracted awaiting the approach of another canister. Note that depending members 15 are located and confined in small radial slots, not shown, in turret or carousel 1.

CANISTER DETAILS

The unique canister is specifically illustrated in FIG. 5 which shows the same in cross-section. The upper or entrance end 91 is recessed at 92 and provided with an annular flexible brush like member 93. A tapered surface 94 is provided to guide a container lid placed therein to be inserted into a container C open end and at the end of the tapered surface are located a plurality of spring pressed balls or the like 95 which forms a temporary rest or support for a lid L. The tapered surface 94 is provided to guide a container lid placed therein to be inserted into a container C open end and at the end of the tapered surface are located a plurality of spring pressed balls or the like 95 which form a temporary rest or support for a lid L. The tapered surface 94 and the spring pressed balls 95 insure that during the initial step of inserting of lid the same is a level or non-canted position. Below the taper and spring pressed balls are rows of apertures or recesses 96 which prevent air from being trapped within the canister 9 which would prevent the lid from traveling smoothly therethrough. At the lower end of the canister a taper 98 and an annular shoulder 97 have been machined or otherwise provided therein to accurately receive the upper end of a container C. The taper 98 serves to guide the peripheral wall portions of the egg-shaped container C to a position where they are contained by the shoulder 97. Also, a recessed shoulder arrangement 99 has been provided on the bottom exterior of the canister to aid in mounting the same on the turret 1. Flexible brushes 93 direct the delicate articles toward the center of the canister and prevent the articles from engaging corners or sharp edges, etc. and also aid in confining the articles therein after leaving the vacuum loading station.

CONTAINER LOADING DETAILS

Figure 4:
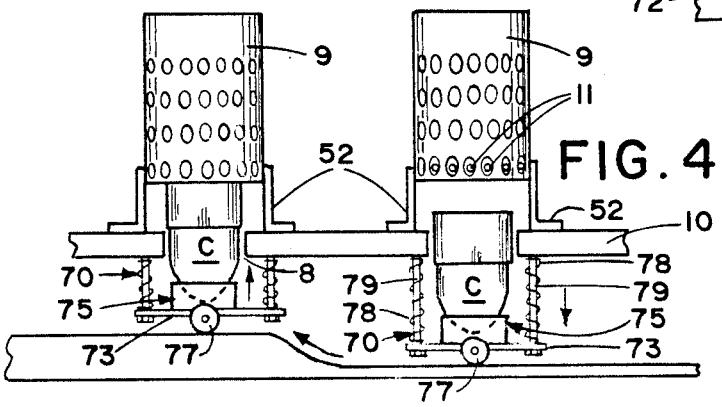
FIG. 4 is a view of the containers being elevated to the article receiving position.

Attention is now directed to FIGS. 1, 2 and 4 which specifically illustrate the positioning of container C into the lower end of a canister 9 and abutting shoulder 97. This feature takes place between stations VI and VII and includes the above mentioned container supplying small carousel or turret 6 having a series of openings 60 for receiving containers C from a supply magazine 62. Conventional means may be employed to transfer containers C from the magazine to the openings 60. The magazine is mounted upon a support 63. The turret 6 is supported on a convenient support 61 for indexing in timed relation with main turret 1 through motor M3. Extending vertically from support 61 and through turret 6 is a support 64 to which is attached a reciprocable coupon loading device 65 having a vacuum cup 66 for retrieving a coupon X from a supply trap 67 supported by member 68. This arrangement retrieves a coupon X from tray 67 and drops the same into an empty container C prior to the said container being indexed to Station VI. As illustrated in FIG. 2, a fixed, curved deflecting arm 69 is positioned below turret 6 and located in the path of container C as the same is indexed by small turret 6 and directs the same from an opening 60 and into a slot 8 directly beneath a canister 9, FIGS. 2 and 4. Note that the lower ends of canisters 9 are supported by brackets 52 on the surface 10 of turrent 1. Attached to the turret 1 beneath each canister 9 is a supporting mechanism 70 for receiving and supporting a container C. Support mechanism 70 has a displaceable section including a bracket 73, a receiver portion 75 for receiving the closed end portion of a container C and secured to bracket 73, and a roller 77 mounted upon the bracket 73 and depending below the cup portion 75. The supporting mechanism also includes spaced guide rods 79 depending from the turret 1 which are surrounded by coil springs 78. The bracket 73 has openings therein for slidably receiving the rods 79 and the springs 78 urge the bracket 73, receiver 75 and roller 77 away from the associated canister 9, as shown at the right hand side of FIG. 4.

Figure 7:
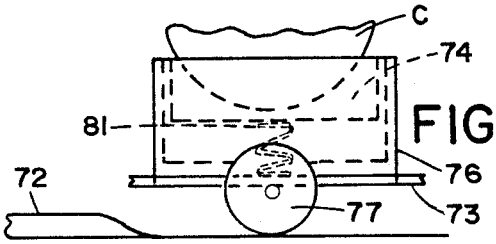
FIG. 7 is an enlarged, schematic, elevational view of a container receiving, displacing, and supporting mechanism.
Figure 8:
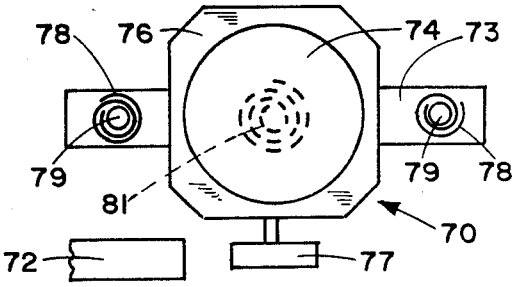
FIG. 8 is a fragmentary top plan view of the structure of FIG. 7 with the container removed.

Receiver portion 75, FIGS. 7 & 8, consists of a cup shaped section 74 vertically displaceable within a housing 76. A coil spring 81 located intermediate the cup shaped section 74 and the housing 76 provides a cushion effect for section 74 and a container supported thereon. The roller 77 which engages a cam track 72 fixedly mounted on base 2 of the housing to elevate and urge container C into the bottom or lower end of canister 9.

As the container is being elevated, polished fingers 11 are withdrawn upon activation of the fluid cylinder arrangement 14 allowing the article to free fall into the container. Cam track 72 only extends from station VI to station XI. As the cam track diminishes at station XI, chute S intercepts the package and transfers same for further processing.

LID APPLICATOR DETAILS

As the canister 9 and loaded container C leaves station VI and before it arrives at the lid applicating stations IX–XI, provisions are made to insure that the article has been completely removed from the canister and placed in the container awaiting a lid. Illustrated at stations VII and VIII are two substantially identical vertically reciprocatable motors 19, the plungers of which have smooth finished ends 191 and which are adapted to enter the top opened end of the canisters as they are indexed thereunder, to insure that the articles have been placed into the container C. Normally only one of the motors 19 is necessary but when bulky articles are to be packaged the second such motor 19 insures that the article has been properly positioned so as not to interfere with the lid applying function. Upon arrival at station IX, FIGS. 1 and 6, a lid positioning mechanism 20 is caused to operate and place a lid L on the top of the balls 95 within the upper opened end of the canister 9. This arrangement 20 includes two laterally spaced, vertically extending, simultaneously actuated double acting fluid motors 23 of substantially identical configuration interconnected by a bracket 24 being mounted to pivot, as at 25, substantially 180° upon actuation of drive mechanism M1. The motors 23 are mounted on the bracket 24 with their rods 26 extending in opposite directions and spaced the same distance from the pivot 25 so that each is capable of assuming the same position as the other when rotated. Each rod 26 has a vacuum cup 27 and a vacuum source 28 associated therewith.

When the machine is first activated, one of its first functions is to capture a disk or lid L as there are none on the suction cups 27,27. The rods 26,26 of cylinders 23,23 extend simultaneously, one going into a cannister and the other capturing a disk L from the magazine 21. Once the disk is captured and the rods of both cylinders 23,23 have been retracted, the cylinders are pivoted by drive mechanism M-1 so that the disk is facing the cannister. Only now is the turret 1 permitted to index. Once the turret indexes the cylinders are simultaneously actuated to extend the rods 26,26, and the suction cup 27 of one cylinder deposits a disk L inside the cannister, and the suction cup 27 of the other cylinder captures a disk L from the magazine 21. The rods 26,26 and suction cups 27,27 are retracted, pivoted by drive M-1, and a disk is again facing the cannisters but will not be deposited until the turret has been indexed again. Note the offset of pivot 25 relative to the center of the canister 9 and lid supply 21. Rather than drive mechanism M1, any number of devices could be employed to rotate this lid application from lid attracting position 180° to the application position.

Figure 10:
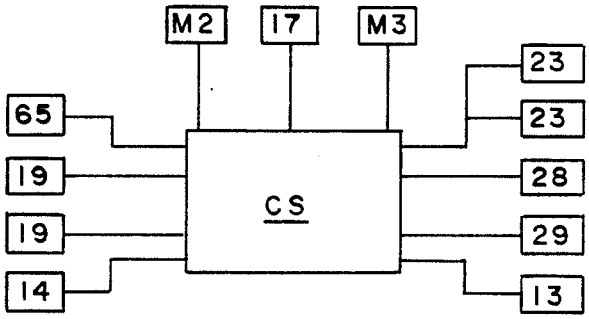
FIG. 10 is a schematic view of the various control elements.

The vacuum or suction devices 100 located at zones I and III are spaced apart enough to accommodate two attendants without interference. The air supply for these devices is supplied by tubes 101 communicating therewith and a pump or the like located within housing 2. These devices could be the continuous running type or could be actuated by a sensor or the like at their entrance upon the presentation of an article thereat. FIG. 10 illustrates schematically a control system for actuating the various carousel or turret drives, the various fluid motor drives, control mechanisms, etc. Such mechanisms and controls form no part of the invention as they are conventional in nature and require only mechanical skill in design to provide same. The sensors referred to in the above description could be one of many presently available.

While a preferred embodiment of the invention has been disclosed, it should be apparent that many modifications therein may readily be made. Further, while the packaging apparatus has been described as being particularly useful in packaging of hosiery or the like, it should be apparent that the same could be employed to package other textile or pliable articles.

What is claimed is:

1. An article packaging apparatus including a support frame, turret means mounted on said frame for indexable rotation about a vertical axis, means for indexing said turret means, a plurality of upstanding open-ended canisters spaced about and secured to said turret means for displacement along an arcuate path, a plurality of gate means mounted adjacent said canisters, means for individually displacing said gate means through the walls of said canister between a first position for effectively closing the lower end of an associated canister to retain an article therein, and a second position where said gate means is withdrawn to open the lower end of the associated canister to permit an article to be discharged therefrom, article loading means located above and in the path of said canisters for placing articles therein when said gate means is in said position, container supporting means positioned adjacent each canister for supporting a container for vertical displacement relative to said associated canister, container supplying means for presenting sequentially generally cup-shaped containers to said container supporting means beneath said canisters as said canisters are indexed past said container supplying means, means for displacing said container supporting means vertically to urge a container supported thereby into engagement with the lower end of an associated canister with the associated canister reaches a predetermined location along said path, and means for applying a closure member to each cup-shaped container.

2. The apparatus as defined in claim 1 wherein said turret means is provided with a plurality of radial slots adjacent said above canisters for permitting said containers to be positioned below said canisters.

3. The apparatus as defined in claim 1 wherein said gate means adjacent each canister includes a plurality of closely spaced fingers.

4. The apparatus as defined in claim 3 wherein said fingers are smooth and highly polished.

5. The apparatus as defined in claim 1 wherein said gate displacing means are fixedly mounted below said turret means on said support frame.

6. The apparatus as defined in claim 1 wherein said article loading means includes an open ended vacuum or suction device adapted to attract and pull an article held thereover into the canister as the same is indexed thereunder.

7. The apparatus as defined in claim 1 wherein said container supplying means includes an indexable second turret means having means associated therewith for placing a container beneath each canister as they are mutually indexed into alignment.

8. The apparatus as defined in claim 7 wherein said second turret means includes plural container receiver openings located along the periphery thereof.

9. The apparatus as defined in claim 8 including a container supply magazine associated with said second turret means.

10. The apparatus as defined in claim 9 including means to move a container from a receiver opening to a position below an associated canister.

11. The apparatus as defined in claim 1 wherein said means for displacing said container supporting means vertically comprises a cam track on which the bottom of the container support means move.

12. The apparatus as defined in claim 1 wherein said closure applying means includes means for removing a closure member from a supply source and initially placing same into the upper end of a canister, and further including means for removing said closure member from said canister and inserting said closure member into the upper end of the container.

13. The apparatus as defined in claim 1 further including means downstream of said closure applying means for ejecting the containers from the canisters as the turret means indexes to transfer said containers to a further processing station.

14. The apparatus as defined in claim 1 wherein each canister comprises a generally elongated tubular member having an open mouth portion for receiving an article and closure member therethrough, an annular flexible brush-like member located therein at the mouth portion thereof, a tapered section extending from beneath said brush-like member to a straight cylinder portion thereof, and spring pressed resistance means located at or near the intersection of said tapered section and straight cylindrical section for releasably supporting a closure member therein, said cylindrical section terminating into a radial shoulder portion at the lower end of the terminating section of said cylindrical section for receiving the open end of a cup-shaped container.

15. An article packaging apparatus comprising, intermittently displaceable conveyor means mounted for rotation about a vertical axis, an opened ended, vertically disposed canister carried by said conveyor means along a precribed path to various work stations, gate means mounted upon said conveyor means in close proximity to said canister, means for displacing said gate means between a first position wherein the lower end portion of said canister is effectively closed for retaining an article therein and a second position for effectively opening the lower end portion of said canister and permitting an article to discharge from said canister, means for directing an article to said canister when said gate means is in said first position, container receiving support means mounted upon said conveyor means and positioned below said canister, means for directing an open ended container to said container receiving support means with said cup shaped container being aligned with said canister, means for urging said cup-shaped container into engagement with said canister, means for depositing a closure member within said canister, said canister including means for releasably supporting said closure member at a preselected position, and means for urging said closure member into locking engagement with said cup-shaped container.

16. An apparatus as recited in claim 15, wherein a plurality of canisters are equally spaced upon said conveyor means, and a distinct gate means is associated with each of said plurality of canisters.

17. An apparatus as recited in claim 15, wherein said container receiving support means includes a member spring biased vertically downwardly away from said canister to support said container with the upper end portion in spaced relation to said canister, and roller means secured to said member.

18. An apparatus as recited in claim 17, said means for urging said cup shaped container into engagement with said canister comprising cam means extending a prescribed distance along said prescribed path.

19. An apparatus as recited in claim 15, said canister comprising a tube-like member defining a plurality of openings extending therethrough, said gate means including a plurality of spaced fingers extending through said openings when said gate means is in said first position.

20. In a machine for packaging articles within a cup-shaped container, conveyor means mounted for displacement along an endless horizontal path, canister means mounted upon said conveyor means, said canister means including an elongated, vertically disposed, generally tubular member having a series of openings extending therethrough, gate means mounted upon said conveyor means, means for selectively displacing said gate means between a first position remote to said tubular member and a second position wherein portions thereof extend through selected openings of said series of openings for effectively closing the lower end of said canister means to support an article therein, spring biased means secured to said tubular member and extending inwardly of the inner peripheral wall of said tubular member for releasably supporting a closure member for the cup-shaped container, and means for urging said closure member past said spring biased means and into engagement with a cup shaped container engaged with the lower end of said canister.

21. In a machine as recited in claim 20, and further including an annular flexible brush member located in the upper open end of said tubular member.

* * * * *